US011605514B2

(12) United States Patent
Stella et al.

(10) Patent No.: US 11,605,514 B2
(45) Date of Patent: Mar. 14, 2023

(54) HIGH FREQUENCY TRANSIENTS SUPPRESSION FOR HVDISCONNECTORS WITH SLIDING RESISTOR

(71) Applicant: General Electric Technology GmbH, Baden (CH)

(72) Inventors: Eros Stella, Roncade (IT); Marco Nosilati, San Dona (IT); Enrico Zozzollotto, Chirano (IT); Fernando Moreira Lagos, Minas Gerais (BR)

(73) Assignee: General Electric Technology GmbH, Baden (CH)

( * ) Notice: Subject to any disclaimer, the term of this patent is extended or adjusted under 35 U.S.C. 154(b) by 0 days.

(21) Appl. No.: 17/365,989

(22) Filed: Jul. 1, 2021

(65) Prior Publication Data

US 2022/0005657 A1 Jan. 6, 2022

(30) Foreign Application Priority Data

Jul. 1, 2020 (EP) ..... 20183533

(51) Int. Cl.
*H01H 31/34* (2006.01)
*H01H 33/16* (2006.01)

(52) U.S. Cl.
CPC ..... *H01H 31/34* (2013.01); *H01H 33/16* (2013.01)

(58) Field of Classification Search
CPC ..... H01H 31/34; H01H 31/28; H01H 33/16; H01H 33/20; H01H 9/42; H01H 9/46
(Continued)

(56) References Cited

U.S. PATENT DOCUMENTS 1,563,833 A * 12/1925 Christensen ..... H01H 33/161 218/148
3,004,116 A * 10/1961 Griscom ..... H01H 33/164 200/48 R (Continued)

FOREIGN PATENT DOCUMENTS

EP 2 600 372 A1 6/2013
FR 2 581 790 A1 11/1986

(Continued)

OTHER PUBLICATIONS

Search Report issued in European Patent Application No. 20 18 3533, dated Nov. 27, 2020, 1 page.

*Primary Examiner* — Thienvu V Tran
*Assistant Examiner* — Sreeya Sreevatsa
(74) *Attorney, Agent, or Firm* — Eversheds Sutherland (US) LLP

(57) ABSTRACT

A disconnector to reduce considerably high voltage and high frequency current generated during the service no-load opening and closing, the disconnector comprising a first main contact a second main contact, a sliding contact and an arcing horn having a length, the disconnector having a connected state, an intermediate state and a disconnected state, wherein in the connected state a first electrical contact is established between the first main contact and the second main contact, in the intermediate state the first electrical contact is interrupted while a second electrical contact exists between the sliding contact and a contact position on the length of the arcing horn, and in the disconnected state the first electrical contact and the second electrical contact are interrupted, wherein (Continued)

at least a part of the length of the arcing horn comprises an electrical filter configured to provide a resistance and an inductance to an electrical current.

13 Claims, 11 Drawing Sheets

(58) Field of Classification Search
USPC ..... 218/45
See application file for complete search history.

(56) References Cited

U.S. PATENT DOCUMENTS

| | | | | |
|---|---|---|---|---|
| 3,182,145 | A * | 5/1965 | Gorman | H01H 31/28 200/256 |
| 4,695,918 | A | 9/1987 | O'Leary | |
| 2013/0134028 | A1* | 5/2013 | Bohori | H01H 15/04 200/550 |
| 2013/0307439 | A1 | 11/2013 | Girlando et al. | |

FOREIGN PATENT DOCUMENTS

| | | | | |
|---|---|---|---|---|
| FR | 2581790 | A1 * | 11/1986 | |
| FR | 2581790 | A1 * | 12/1988 | |
| FR | 2943451 | A1 * | 9/2010 | H01H 31/026 |

* cited by examiner

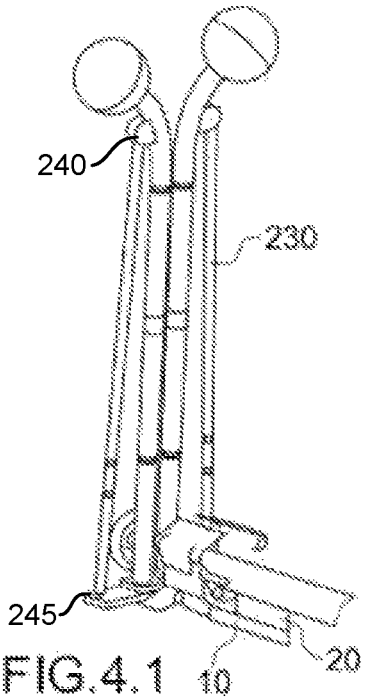
FIG.4.1
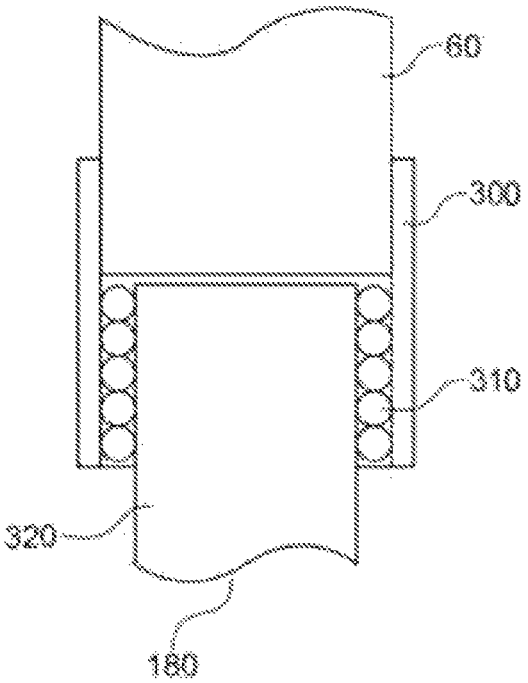
FIG.5.2
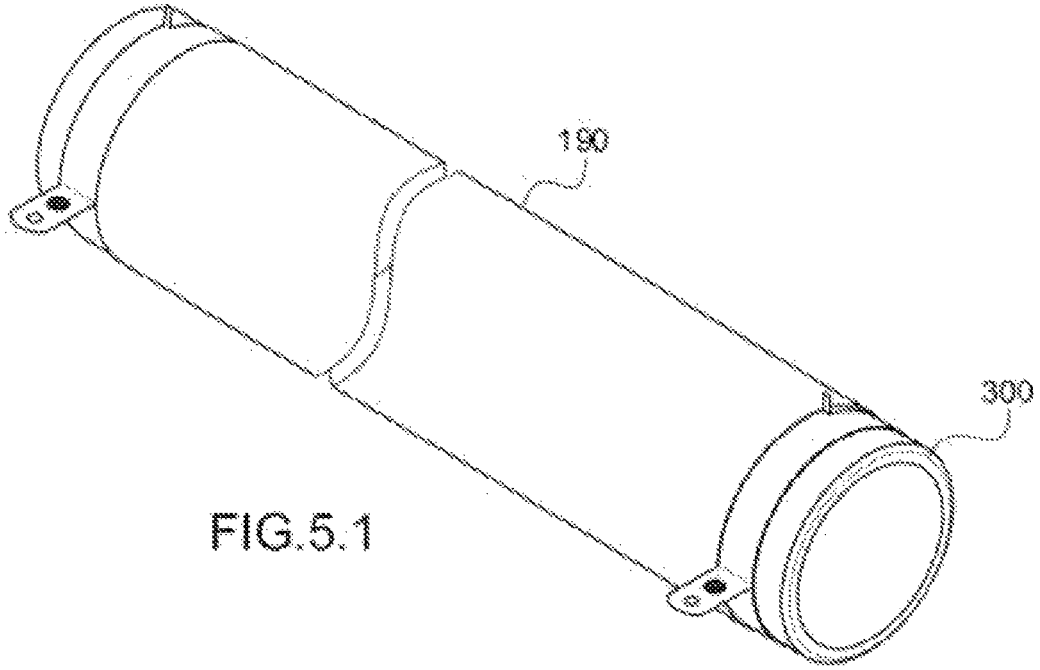
FIG.5.1

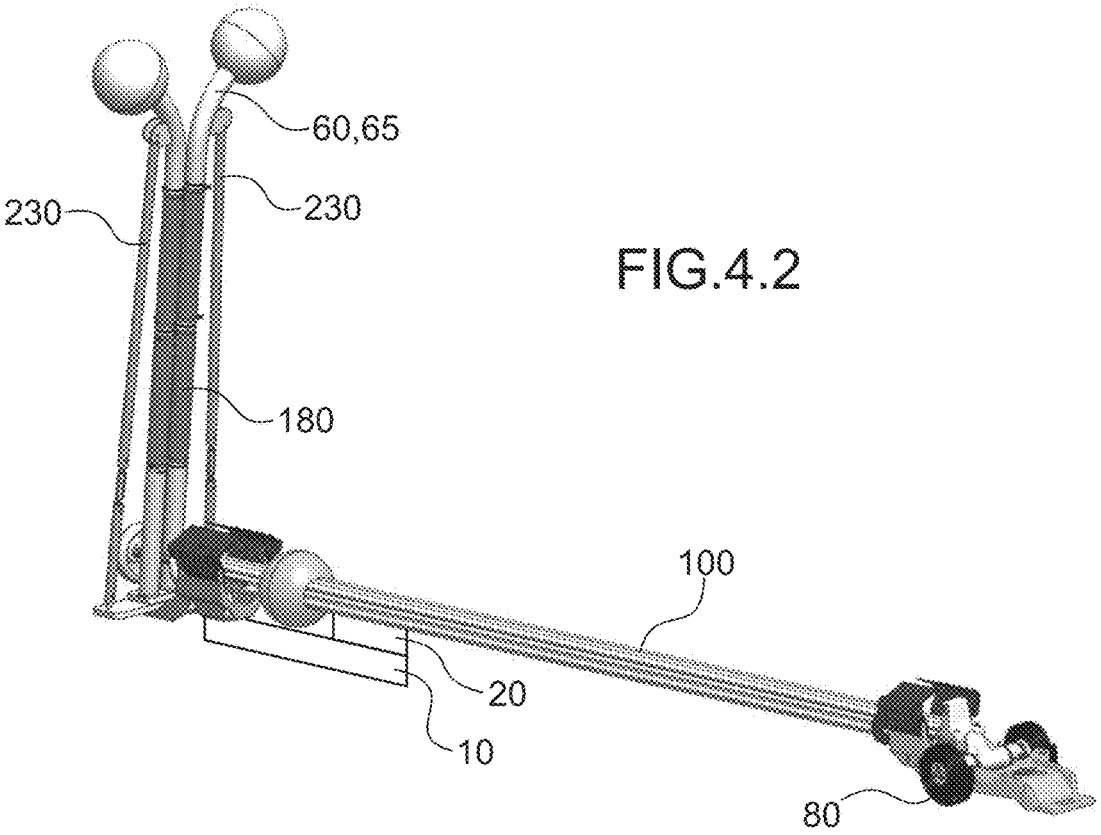
FIG.4.2
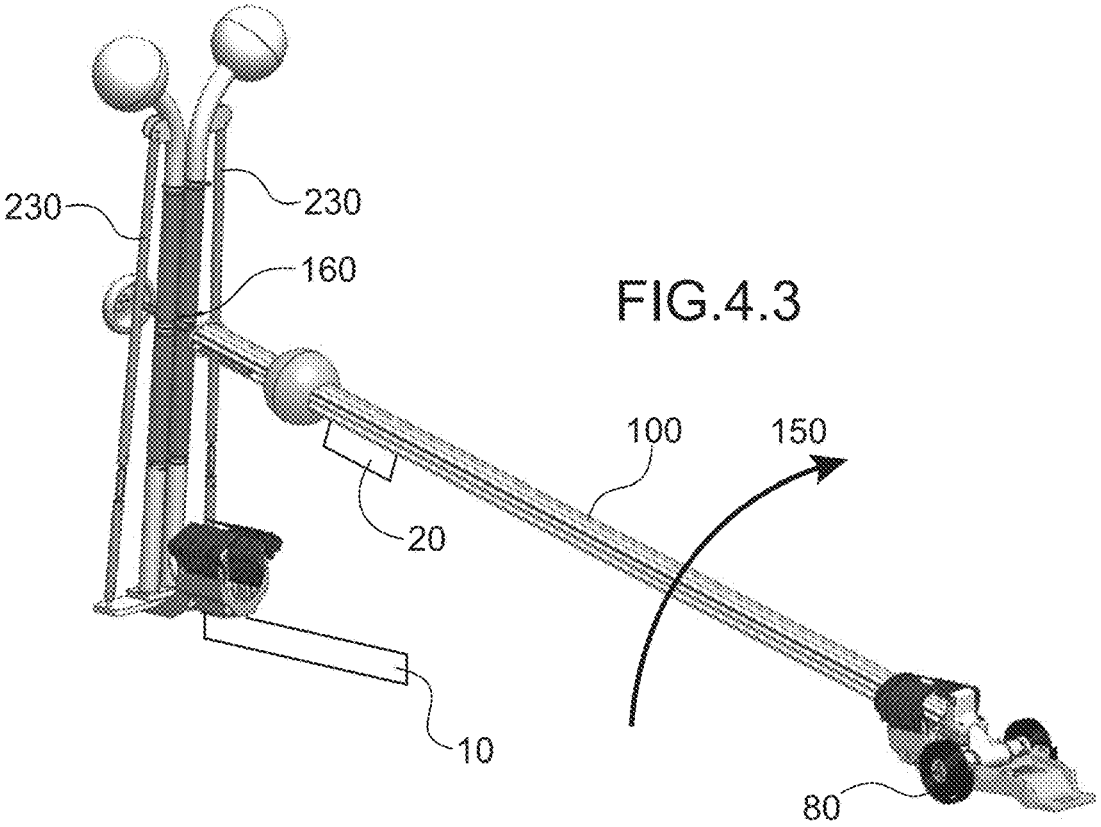
FIG.4.3

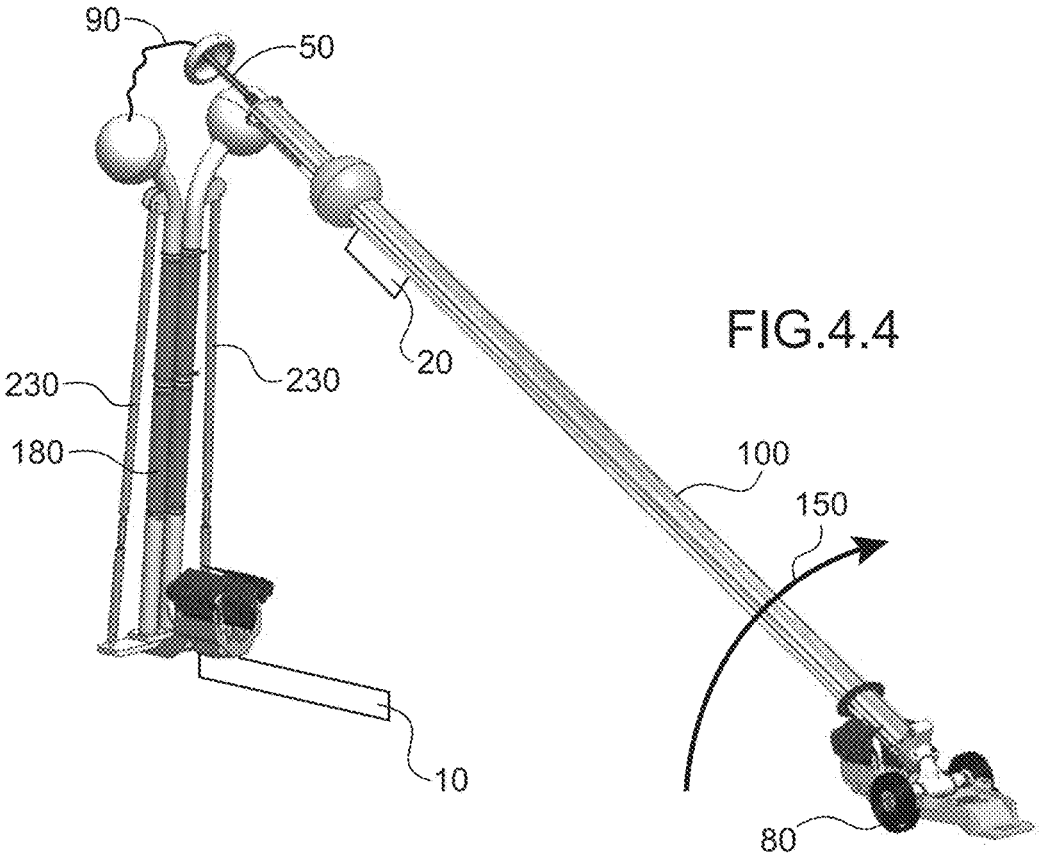
FIG.4.4
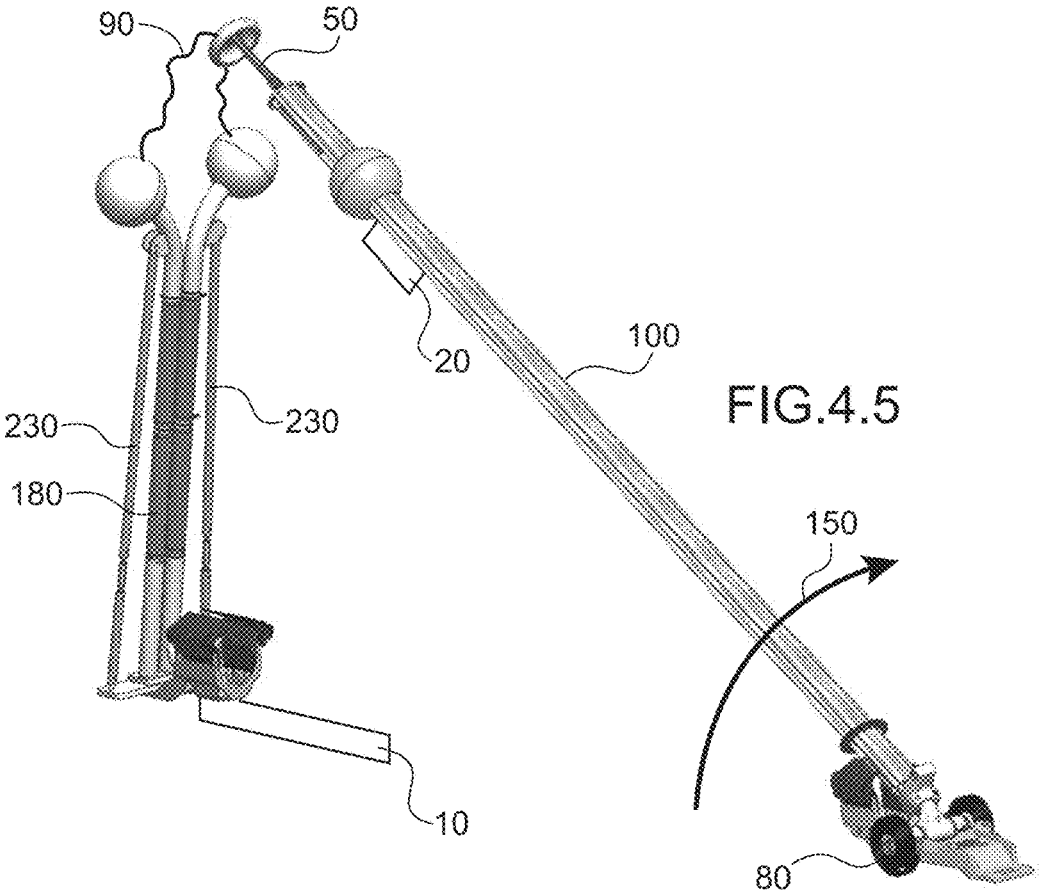
FIG.4.5

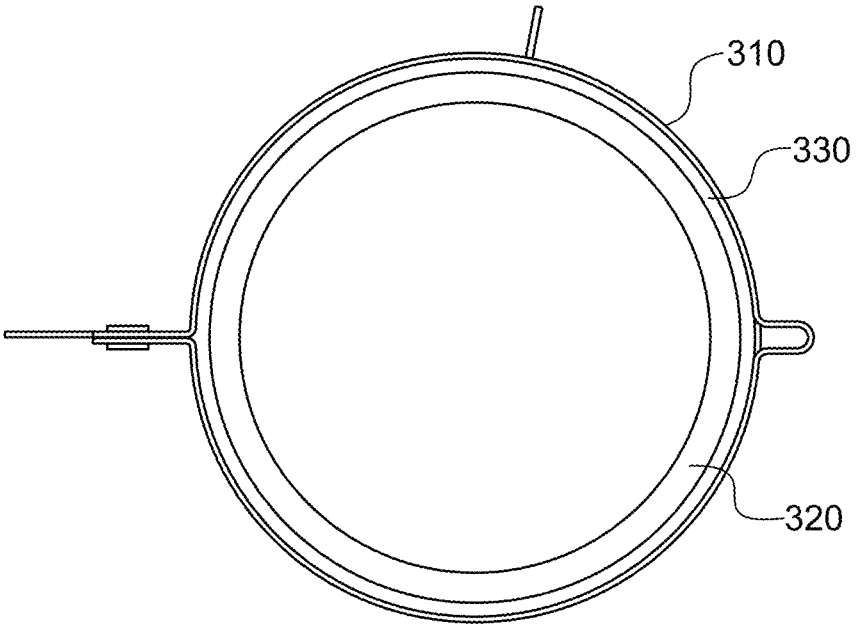
FIG.6.1
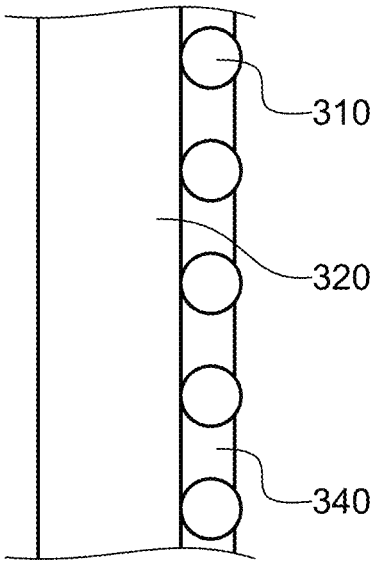
FIG.6.2

HIGH FREQUENCY TRANSIENTS SUPPRESSION FOR HVDISCONNECTORS WITH SLIDING RESISTOR

CROSS-REFERENCE TO RELATED APPLICATIONS

This application claims the priority benefit of European Application No. 20183533.7, filed Jul. 1, 2020, which is incorporated herein, in its entirety, by reference.

BACKGROUND

The present invention concerns a disconnector comprising a filter.

SUMMARY OF THE INVENTION

Consequently, the present invention suggests a disconnector for interrupting a high voltage current. The disconnector is configured to reduce considerably high voltage and high frequency current generated during the service no-load opening and closing.

The disconnector comprises a first main contact, a second main contact, a sliding contact and an arcing horn having a length, the disconnector having a connected state, an intermediate state and a disconnected state, wherein in the connected state a first electrical contact is established between the first main contact and the second main contact, in the intermediate state the first electrical contact is interrupted while a second electrical contact exists between the sliding contact and a contact position on the length of the arcing horn, and in the disconnected state the first electrical contact and the second electrical contact are interrupted, wherein at least a part of the length of the arcing horn comprises an electrical filter configured to provide a resistance and an inductance to an electrical current.

The disconnector may further comprise a continuity of contact positions exists along the length of the arcing horn comprising the electrical filter and wherein the sliding contact is configured to adopt a given contact position from the continuity of contact positions by sliding along the length of the arcing horn comprising the electrical filter.

The filter may comprise a conducting wire wound upon a support, preferably such that two layers or more of wound wire are provided.

Preferably, the filter is configured such that, in use, a dielectric gradient is smaller than 20 kV per cm and/or a voltage between consecutive turns of the wire is about 1.2 kV.

The filter of the arcing horn may comprise a stabilization layer, preferably a stabilization layer comprising an aluminiumoxide, the stabilization layer being provided between the wire and the support.

Preferably, a cement is filled between windings of the conducting wire.

The filter and the sliding contact may further be configured such that the sliding contact is in contact with at least three windings of the wire while sliding on the filter.

The filter can comprise an electrically conducting band, the band being configured to provide a sliding surface on the filter for the sliding contact.

Preferably, the filter is connected to the arcing horn via a connection cylinder, the connection cylinder being dimensioned such that an impedance provided by the connection plate is adapted to the filter.

An opening and/or closing operation may be configured such that the sliding contact moves with a constant sliding speed while the sliding contact is in contact with the filter.

The disconnector can also be configured as a vertical type disconnector with an arcing horn comprising a left branch with a first electrical filter and a right branch with a second electrical filter, wherein the sliding contact is configured to slide in a sliding space between the left branch and the right branch of the arcing horn.

An opening and/or closing operation is advantageously configured such that the sliding contact moves with a sliding speed, whereby the sliding speed increases or decreases while the sliding contact is not in contact with the filter.

An advantageous form of the sliding contact comprises a first sliding part, a second sliding part and a spring, wherein the spring is configured to press the first sliding part and the second sliding part against the left branch and against the right branch of the arcing horn.

Further, the disconnector may comprise a length adjustable tie-rod, wherein the tie rod is configured such that changing a tie-rod length leads to a change of a sliding space size.

Further, the sliding contact may be pressed with a force between about 50 N and about 100 N on the arcing horn.

BRIEF DESCRIPTION OF THE DRAWINGS

The present invention will be more clearly understood based on the following drawings:

FIGS. 4.1 to 4.5 show a disconnector comprising a tie rod in different states, FIG. 5.1 shows a filter, FIG. 5.2 shows a connection cylinder, FIG. 6.1 shows a cut through a filter along a first plane, FIG. 6.2 shows a detail view of a cut through a filter.

DETAILED DESCRIPTION

The present invention concerns a disconnector for isolating parts of a high-voltage grid. These high voltage grids are an interconnected network for delivering electricity from producers to consumers and generally present an alternating frequency of 50 or 60 Hertz (alternating current, AC current).

A high voltage disconnector is a mechanical switching device which provides an isolating distance for isolating a circuit or equipment from the source of power (for example a generator) when the disconnector is in an open position. In other words, in an open position, a gap isolates a load side from a source side. In disconnectors working in air (called high-voltage air break disconnectors), this isolating distance is air-filled (air gap).

Two typical high-voltage air break disconnector are the vertical-break disconnector and the pantograph type disconnector. FIGS. 1, 2, 3 and 4 show a vertical-break disconnector. FIGS. 9, 10, 11, and 12 show a pantograph type disconnector.

The disconnectors may further be equipped with an arcing horn, which is also called a horn gap device. The arcing horn provides the last point of conductor to conductor contact during the opening procedure. For example, the arcing horn provides the last contact point or contact position by a metal to metal contact during the opening procedure of the disconnector. After this point or past this position, at the end of the opening procedure, when the disconnector is fully opened, only the air-filled isolating distance (air gap) separates a first electrical side (which can be a source side of the network) from a second electrical side (which can be a load side of the network) of the disconnector. The air gap providing the separation between the source side and the load side is therefore established between a part of the arcing horn and a further contact of the disconnector.

Figure 1:
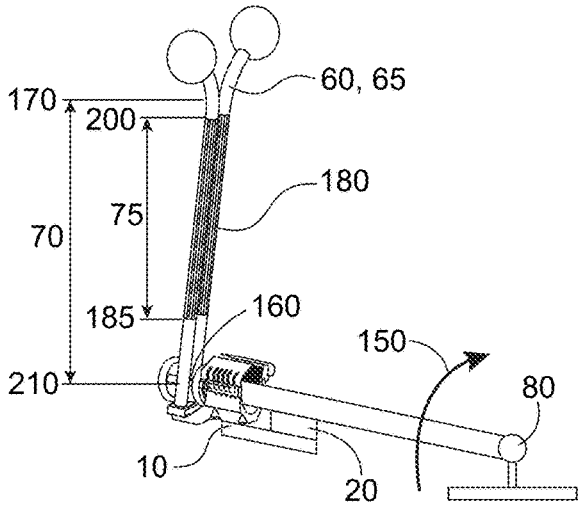
FIG. 1 shows a disconnector in a closed state.
Figure 2:
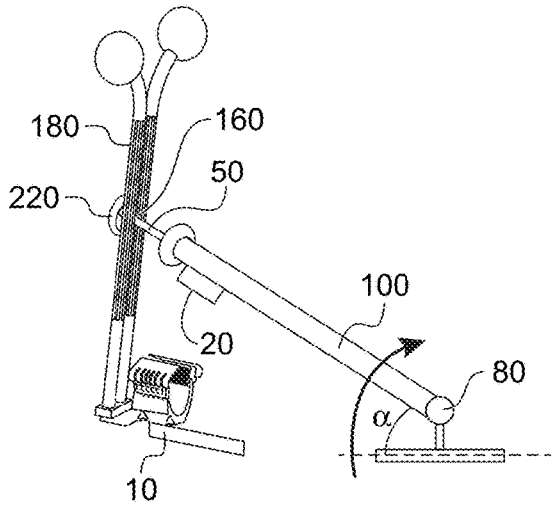
FIG. 2 shows a disconnector in an intermediate state.
Figure 3:
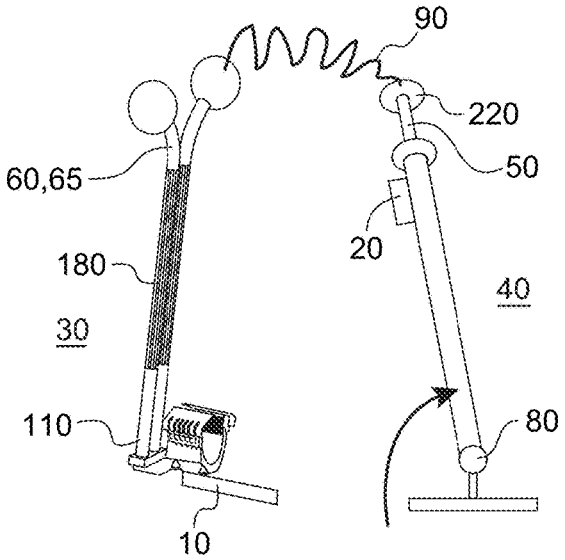
FIG. 3 shows a disconnector in an opened state.

FIGS. 1, 2 and 3 show a vertical-break disconnector equipped with an arcing horn. The disconnector comprises a fixed portion (110) with a first main contact (10) and a pivoting portion (100) with a second main contact (20). Also shown is a pivot point (80) of the pivoting portion (100). The pivoting portion has a pivoting portion end (220) at the ending opposed to the pivot point (80). During an opening movement (150) of the disconnector, the pivoting portion (100) pivots around the pivot point (80). The pivoting portion (100) comprises a sliding contact (50). Further shown is an arcing horn (60) having an arcing horn length (70) between a lower end (210) and an upper end (170). The arcing horn is fixed on the fixed portion. The arcing horn is shown in the present figures has a left branch (65) and a right branch (65). However, the arcing horn could also have only one branch, the left branch or the right branch.

The fixed portion (110), the arcing horn (60) and the first main contact (10) form a first electrical side (30). The first electrical side can be a source side i.e. a side of the disconnector where a power source, such as a generator, is situated. The pivoting portion (100) with the second main contact (20) and the sliding contact (50) form a second electrical side (40). The second electrical side can be a load side i.e. a side of the disconnector where a power consumer is situated, such as a network of houses. The disconnector is used to establish a disconnection by an air gap between the first electrical side and the second electrical side. The sliding contact preferably comprises a steel inox material for providing an electrical contact. The sliding contact may be a Carbon 40 steel i.e. Fe C40.

FIG. 1 shows the disconnector in a closed state. In the closed state, the first electrical side (30) is connected to the second electrical side (40). A current connection is established via the first main contact (10) and the second main contact (20). A current connection is also established via the arcing horn (60) and the sliding contact (50).

FIG. 2 shows the disconnector in an intermediate state. In the intermediate state, the first electrical side (30) is still connected to the second electrical side (40). The first main contact (10) and the second main contact (20) are separated from each other by a gap. No current flows from the first main contact to the second main contact. A current connection is however still established via the arcing horn (60) and the sliding contact (50). In the intermediate state, the pivoting portion (100) can adopt a plurality of positions by pivoting around the pivot point (80). The contact portion (50) can adopt a plurality of contact positions which are situated on the length of the arcing horn (70). The contact positions form a continuity on the length (70) of the arcing horn. In other words, while the pivoting portion (100) pivots around the pivot point, the sliding contact (50) slides along the length of the arcing horn (70) and the electrical contact between the first electrical side (30) and the second electrical side (40) remains established via the sliding contact and the arcing horn. A current still flows from the fixed portion (110) through the arcing horn until the contact position establishing an electrical contact between the arcing horn and the sliding contact, then through the sliding contact and through the remaining pivoting portion (100) to the pivot point.

FIG. 3 shows the disconnector in an opened state. In the opened state, the first electrical side (30) is disconnected from the second electrical side (40). The first main contact (10) and the second main contact (20) are separated by an air gap. Also, the arcing horn (60) and the sliding contact (50) are separated by an air gap. More precisely, the arcing horn length (70) and the sliding contact (50) are separated by an air gap. Depending on the size of the air gap separating the sliding contact and the arcing horn and further conditions (for example network's voltage, network's topology, air humidity) an arc (90) may be present between the arcing horn and the pivoting portion.

In the following, the opening operation of the disconnector will be described. At the beginning of the operation, the disconnector is in the closed state (FIG. 1). An electrical current can flow from the first electrical side (30) to the second electrical side (40) by passing through the first main contact (10) to the second main contact (20) and also by passing through the position where the sliding contact (50) touches the arcing horn length (70). The contact position (160) is the point where the sliding contact (50) touches the arcing horn length (70) and by touching establishes a contact via which an electrical current can flow. The opening operation starts by pivoting the pivoting portion (100) in direction of an opening movement (150) around the pivot point (80), see FIG. 2. The first main contact (10) and the second main contact (20) become separated by an air-filled gap. The sliding contact (50) slides along the arcing horn length (70) in direction of the upper end (170). During this sliding movement, the sliding contact remains in electrical contact with the arcing horn. The electrical contact is established at a contact position where the sliding contact touches the arcing horn on a length of the arcing horn (70). Along the length of the arcing horn (70), a continuity of contact positions exists. In other words, as long as the sliding contact slides along the length of the arcing horn (70), the electrical contact between the first electrical side and the second electrical side remains established and an electrical current can flow through this contact position (160) on the arcing horn length and the sliding contact (50).

The sliding contact (50) remains in physical contact with the arcing horn until the sliding contact (50) has reached the upper end (170) of the arcing horn length (70). After this point and continuing the opening movement (150), an air gap is established between the sliding contact and the arcing horn. At this point, the first electrical side (30) is isolated from the second electrical (40) side by an air gap. The first main contact and the second main contact are separated by an air gap. The arcing horn and the sliding contact are separated by an air gap.

Under certain circumstances, an arc (90) may occur between the pivoting portion (100) and the arcing horn (60)

directly after the air gap between the sliding contact and the upper end (170) of the arcing horn length becomes established. An arc will occur in most working conditions under which the present disconnector is used. The arc intensity and duration vary in dependence of the conditions in which the disconnector is operated (air humidity, atmospheric pressure, grid's topology, voltage difference across the open-gap and current passing through the contacts in the moment of opening operation).

More precisely, the arc will occur between the pivoting portion end (220) and near the upper end (170) of the arcing horn. Continuing the opening movement (150) increases the air gap between the pivoting portion and the arcing horn. The arc (90) remains existent until the air gap has reached a given limit size and then becomes extinguished. The limit size depends on electrical conditions and air conditions. The arc will become extinguished when the power dissipated by the medium surrounding the arc (for example air as medium) is more than the power generated by the arc. In this case, the electrons and ions that compose the arc channel recombine, thereby resuming the insulating property of the medium (for example air as medium). The power generated by the arc is reduced by increasing the arc's length when opening the disconnector. By increasing the arc's length, the arc's resistance is increased and thereby lowering the arc current and thereby the arc power ($P=R*I^2$, P: power, R: arc resistance, I: current). The power dissipated by the arc is also increased by the arc lengthening because the heat exchanged between the arc and the surrounding medium (i.e. the heat exchanged between the arc and the surrounding air) is increased with an increased arc length. The arc's length is increased by separating the disconnector contacts. Once the arc has been extinguished, the arc will not resume if the ionized path left by the extinguished arc has been swept away and the open-gap distance of the insulating medium is enough to withstand the voltage difference between source and load side i.e. when the energy injected into the elongated arc is no more sufficient to maintain the arc.

During the existence of the arc (90) a current continues to flow via the arc. The current flows from the pivoting portion end (220) via the arc (90) to the upper end (170) of the arcing horn, then through the arcing horn length (70) to the fixed portion (110) and then further to the equipment connected to this side.

During the existence of the arc, the arc repeatedly breaks down and re-strikes. This breaking down and re-strike is caused by the alternating voltage. Repeated breaks and re-strikes of the arc occur as a consequence of the interaction between the arc, the disconnector and a network attached to the disconnector. When the arc is conducting, the voltage of both source and load side are assumed the same. The moment the arc is extinguished, the voltages are no longer the same. An electrical source side voltage assumes the grid's voltage whilst an electrical load side voltage assumes a DC voltage level related to the trapped charges that remained in the electrical load side part which is isolated from the grid. These voltage levels are different and, therefore, a voltage difference across the contacts appears. When this voltage difference is enough to break the medium's dielectric withstand, the arc resumes (re-strikes) after having been extinguished.

The arc itself and the breaking and re-striking of the arc cause transient oscillations of voltage and of current. These transient oscillations are produced in the disconnector and propagate into the network to which the disconnector is connected.

The frequency of these transient oscillations is by far higher than the frequency of the voltage and current at normal operation (grid nominal frequency), when the disconnector is closed. This grid nominal frequency is 50 Hz or 60 Hz.

The reliability of the network equipment will be affected by the transient oscillations. The transient oscillations cause an increased wear. The transient oscillations may encounter a resonance in the equipment, in particular in the component closest to the disconnector, for example in the current transformer. The reliability of the current transformer can therefore be compromised due to this high frequency oscillation. The transient voltage and current may therefore endanger components of the network. It is therefore highly recommendable to reduce the occurrence of these voltage and current transients. The frequency of the oscillation caused by the arc varies widely and is related to the grid's topology and the electrical parameters of the grid's components (capacitance inductance). The frequency of the oscillations can reach several mega Hertz (MHz).

To reduce the transients an inductive-resistive filter is integrated into the arcing horn. The inductive-resistive filter has an inductive part and a resistive part. The inductive part filters the transient oscillations. The resistive part smoothes abrupt voltage transitions which occur during restrikes of the arc.

FIGS. 1, 2 and 3 show an inductive-resistive filter (180) having a lower filter end (185) and an upper filter end (200) and a filter length (75) between the lower filter end and the upper filter end. The filter replaces the branch (65) of the arcing horn on the filter length (75). The filter is inserted within the length of the arcing horn (70) instead of the material of the branch (65) on this length. The filter is integrated between the lower end (210) and the upper end (170). Preferably, a distance between the lower end (210) and the lower filter end (185) chosen such that no arc occurs between the first main contact (10) and the second main contact (20) when, during the opening and/or closing of the disconnector, the contact position (160) of the sliding contact (50) starts to slide on the filter (180) i.e. when the contact position (160) is situated at the lower filter end (185). Preferably, the distance between the lower end (210) and the lower filter end (185) is chosen as 10 cm or more.

The arcing horn as shown in the present figures has a left branch (65) and a right branch (65). However, the arcing horn could also have only one branch, the left branch or the right branch. In an arcing horn comprising a left branch and a right branch, the filter can be integrated into the left branch or into the right branch. It is also possible to integrate a first filter into the left branch and to integrate a second filter into the right branch i.e. to integrate two filters into the arcing horn. Using a first filter and a second filter (i.e. two filters) allows dissipating a greater amount of power during the opening of the disconnector as the current propagates at the same time through the first filter and through the second filter. Furthermore, a mechanical stability of the pivoting is improved. A force exerted from the first filter on the sliding contact is counterbalanced by a force exerted from the second filter on the sliding contact. In summary, a mechanical balance during movement exists. The shape of the two resistors is similar to a fork with the sliding contact inside. This shape closes the forces on itself and the stresses don't affect the main arm.

Furthermore, the two resistors are advantageous when the arc is very extendable as it is the case for the vertical break that drags the arc behind it during the opening phase.

FIG. 5.1 shows a filter before integration into the disconnector. The filter has a filter surface (190).

FIG. 5.2 shows a connection cylinder (300) positioned at an ending of a filter (180). The plate (300) is configured to provide an electrical connection and a mechanical connection between an arcing horn (60) and the filter (180). The filter (180) preferably is provided with a connection cylinder at both ends in order to replace a part of the arcing horn length.

The filter (180) is connected to the arcing horn (60) by a connection cylinder (300). The connection cylinder contacts the wire (310) of the filter on a first end and the arcing horn (60) on a second end and thereby establishes an electrical and a mechanical connection.

The connection cylinder preferably comprises copper and/or aluminum as material. The connection cylinder is dimensioned such that an impedance provided by the connection cylinder is adapted to the filter. The connection cylinder provides an impedance i.e. a resistance and an inductance. The impedance of the connection plate adds to the impedance of the filter. The connection plate provides an impedance for a current flowing along the arcing horn and the filter. The cylinder thickness is chosen thin enough such that the impedance produced by the cylinder remains acceptable with respect to the impedance of the filter and is thereby adapted to the filter. The cylinder thickness is chosen thick enough such that the cylinder assures the mechanical connection between the filter and the arcing horn. The connection cylinder may have a diameter of about 50 mm, a wall thickness of about 1 mm and a cylinder length of about 100 mm. Connecting the filter to the arcing horn using the connection cylinder is particularly advantageous as an electrical contact between the arcing horn and the filter is improved.

The filter comprises a wire wound on a cylindrical support. For example, a Ni—Cr alloy or a twisted constantan wire can be used. The wire can be wound upon a ceramic support. Preferably, the ceramic support is a ceramic insulator or a porcelain insulator. Porcelain insulators may comprise clay, quartz or alumina and feldspar. The support may be covered with a smooth glaze to shed water. A porcelain rich in alumina has the advantage of providing a high mechanical strength. Therefore, the support may comprise a porcelain insulator comprising alumina. Advantageously, the porcelain is configured to have a dielectric strength of about 4-10 kV/mm. As the current needs to flow through this wire, a resistance and inductance is provided by the length of the wire and the geometry of the coil. Consequently, the size of the resistance and inductance opposed to the current depends on the length of the wire the current needs to pass. A longer distance therefore leads to a greater resistance opposed to the current. The wire needs to be isolated to avoid a shortcut between the turns of the coil. The isolation is provided such that a contact with the sliding contact can be established. The contact between the wire of the filter and the sliding contact can be provided by an electrically conducting band on the resistor. The band provides the galvanic contact between the wire of the filter and the sliding contact. The band also provides a sliding surface on the filter for the sliding contact.

When opening the disconnector, the sliding contact (50) now first slides on the length of the arcing horn (70) until reaching the lower filter end (185). The sliding contact then continues to slide on the filter surface (190) from the lower filter end (185) to the upper filter end (200). The sliding contact then continues to slide on the arcing horn length until reaching the upper end (170). Continuing the opening movement (150), an air gap is established. An arc (90) may occur between the pivoting portion (100) and the arcing horn (60).

During the sliding of the sliding contact along the arcing horn length (70), an electrical contact remains established between the sliding contact (50) and the arcing horn length (70) at the contact position (160).

FIG. 2 shows the disconnector in an intermediate state between the closed state and the opened state. In this position, the current flows from the pivot point (80) through the pivoting portion (100) to the contact position (160) established between the sliding contact (50) and the filter (180). In the state shown in FIG. 2, the contact position (160) is situated on the filter. The current continues to flow through the part of the filter situated between the lower filter end (185) and the contact position (160). In this state of the opening process, the part of the filter providing a filter to the current is therefore the part of the filter situated between the lower filter end (185) and the contact position (160). The current then flows from the lower filter end to the fixed portion and from there to the network to which the disconnector is connected.

During the opening movement (150), the position where an electrical contact is established moves from the lower end (210) to the upper end (170). While the sliding contact slides on the filter during the opening movement (150), the length of the part of the filter through which the current needs to flow becomes gradually increased. Therefore, the resistance and inductance, provided by the filter, opposed to the current becomes gradually increased. In other words, the resistance and inductance become gradually inserted into the current flow by the opening movement (150). This means that the impedance inserted into the circuit becomes gradually increased. Gradually increasing the circuit impedance is particularly advantageous over abruptly changing the circuit impedance. Abruptly increasing or decreasing the circuit impedance causes switching overvoltage oscillations which may also be harmful to the grid's components. The filter can be configured and dimensioned such that an opening angle alpha between a horizontal line and the pivoting portion is about 30 degrees when the pivoting portion end (220) is situated near the upper filter end (200). Opening angle alpha is indicated in FIG. 2.

As stated beforehand, continuing the opening movement (150), an air gap is established. An arc (90) may occur between the pivoting portion (100) and the arcing horn (60). When the arc occurs, a current continues to flow from the pivoting portion end (220) via the arc (90) to the upper end (170) of the arcing horn, then through the complete filter (180) from the upper filter end (200) to the lower filter end (185) and then to the fixed portion (110) and to network to which the disconnector is connected.

A current flow through the filter, as described beforehand, provokes a heating of the filter. The heating depends on a time duration during which the current flows through the filter. This time duration depends on a sliding speed of the sliding contact on the arcing horn. The sliding speed determines a duration of an opening process of the disconnector. Therefore, it determines a time duration during which the current flow through the filter exists. A lower sliding speed therefore leads to a longer time duration during which the current flows through the filter and thereby leads to more heating of the filter than a higher sliding speed. A lower sliding speed leads to more filter heating compared to a higher sliding speed.

The filter has an inductive property or inductance and a resistive property or resistance. Both properties together provide an impedance. The impedance is gradually inserted into the circuit during the opening of the disconnector as described beforehand.

The inductance of the filter opposes to a change in the electric current flowing through the filter. A faster change, i.e. a higher frequency, leads to a greater opposition. At the frequency range of the transient oscillations of the current and the voltage, the inductance of the filter has an influence on the current and the voltage. The filter provides an impedance at the frequency range of the transient oscillations. The high-frequency currents generated by the arc restrikes are therefore blocked and/or smoothed by the inductive part of the filter. The filter therefore acts like a coil, opposing the oscillating transient current which is passing through the filter. The inductive part of the filter blocks the higher frequency part of the voltage transient's frequency spectrum. This blockage results in part of the voltage transients which would have been applied on the grid's components are now being applied in the filter itself.

The inductance of the filter depends on the number of turns of the coil and on the physical dimension of the coil. The value of the inductance is determined by simulations. The value of the inductance is achieved during manufacturing of the filter by choosing a number of turns of wire as well as a length and a diameter of the filter.

The resistive part or resistance of the filter increases the time constant of the charge transferring between a source side and a load side of the filter. The increase of the time constant lowers the frequencies associated with the transient oscillations. The resistance decreases the magnitude of the transient current.

The inductive part and the resistive part alone or in combination reduce the amount of energy which is transferred to the grid's components. The inductive part and the resistive part of the filter thereby reduce the damage which an energy surge may cause in components of the grid.

The opening operation of the disconnector is preferably adapted when a filter is added to the disconnector. The sliding speed of the sliding contact (50) between the lower filter end (185) and the upper filter end (200) is adapted as well as the speed with which the pivoting portion (100) moves between the lower end (210) and the lower filter end (185) and between the upper filter end (200) and the upper end (170) and the speed after the upper end (170). It is preferable to use a constant sliding speed in order to prevent damages to a surface of the filter. The opening and/or closing operation are configured such that the sliding contact moves with a constant sliding speed while the sliding contact is in contact with the filter. The sliding speed of the opening movement (150) is configured high enough such that an overheating of the filter does not occur. In other words, the sliding speed is configured high enough such that an opening operation is short enough in time such that the heating of the filter remains low enough.

The sliding speed is configured low enough that a surface damage to the filter does not occur by a too important friction between the sliding contact and the surface of the filter. An increase in sliding speed leads to an increase in friction between the sliding contact and the filter surface. Preferably the sliding speed is adapted to have a short arc duration. The sliding speed may be adapted such that an arc is present during a few seconds, more preferably during 2 seconds or less. Preferably, an actuation control mechanism is used to control the opening movement. The actuation control mechanism may be the device and method described by document US2013307439A1. Typically, sliding speed during a contact between the sliding contact and the filter is about 1 m/s. A total duration of the opening movement may be between about 10 seconds and about 12 seconds. At a maximal open position, the sliding speed may slow down to about 0.1 m/s. If a constant sliding speed is used for the whole opening process a sliding speed of about 0.3 m/s may be used.

Figure 13:
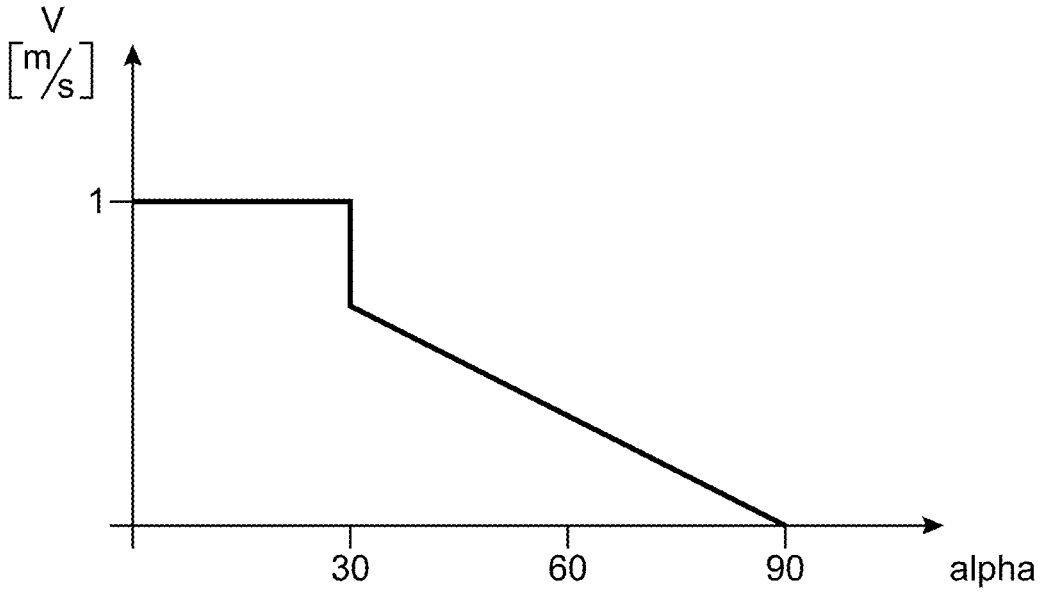
FIG. 13 shows a speed profile.

FIG. 13 shows an example of a sliding speed of the sliding contact on the arcing horn at different opening angles alpha.

At the beginning of an opening movement (FIG. 1), the sliding speed may remain constant, for example at a speed of about 1 m/s. At an angle of about 30 degrees, the sliding speed may be reduced. An angle alpha of about 30 degrees may correspond to a position of the pivoting portion (100) where the sliding contact (50) is situated at an upper filter end (200). For example, at an opening angle of 30°, the sliding speed may drop by about 30%. Between an opening angle alpha of about 30° and 90°, the sliding speed may linearly drop.

A pressure between the sliding contact (50) and the filter (180) can be adapted to prevent damages to the filter and to assure a sufficient electrical contact between the sliding contact and the filter. An increase in pressure leads to an improved electrical contact. An increase in pressure also leads to an increase in friction between the sliding contact and the filter surface, and this increase in friction leads to an increase of wear of the filter and of the sliding contact. The pressure therefore needs to be high enough to assure the electrical contact and low enough to keep the friction below an acceptable level. A wear of the sliding surfaces is caused by a combination of the sliding speed and the pressure. A higher pressure therefore requires a lower sliding speed in order to maintain an acceptable wear. In summary, a sliding speed and a pressure need to be adapted to provide a sufficient electrical contact, a low enough wear of the surfaces sliding on each other and an opening duration short enough to result in a low enough heating of the filter.

FIG. 4.1 shows the disconnector with the arcing horn of the preceding pictures. Additionally, a tie rod has been added to the disconnector. The tie rod (230) connects a base plate (240) with a position near the upper end (170) of the arcing horn. A length of the tie rod can be adjusted by a length adjustment mechanism (245). Changing a tie-rod length leads to a change of a sliding space size. In particular, increasing the length of the length adjustment mechanism decreases a sliding space (260) situated between the two arcing horns (60) as the arcing horns pivot around their fixation point on the baseplate (240). The sliding space (260) is a space provided between the arcing horns where the sliding contact (65) slides and provides an electrical contact. The sliding space is mostly constant between the upper end (170) and the lower end (210) of the arcing horn.

FIGS. 4.2 to 4.6 show the disconnector comprising the tie rod during an opening operation of the disconnector.

Figure 7:
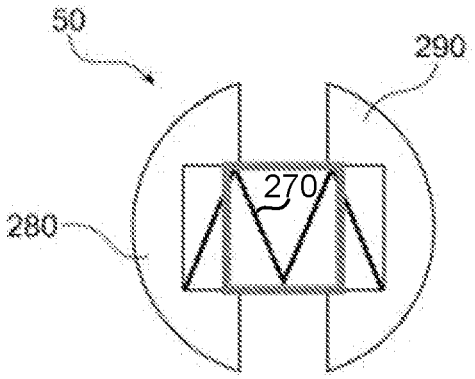
FIG. 7 shows a sliding contact.

FIG. 7 shows a preferred embodiment of a sliding contact (50). Shown is a cut through the sliding contact (50) when seen in direction of an elongation of the pivoting portion (100). The sliding contact comprises a first sliding part (280), a second sliding part (290) and a spring (270). The spring is configured to press the first sliding part and the second sliding part outward relative to each other. The spring is situated between the first sliding part and the second sliding part. In an extended state the spring keeps the first and second sliding part at a distance such that the exterior side of the sliding contact is larger than the sliding space (260). Thereby, the spring presses the first sliding part and the second sliding part against the left branch and the right branch of the arcing horn when the sliding contact slides within the sliding space. The first sliding part (280) and/or the second sliding part (290) may comprise a C40 carbon steel i.e. Fe C40.

Figure 8:
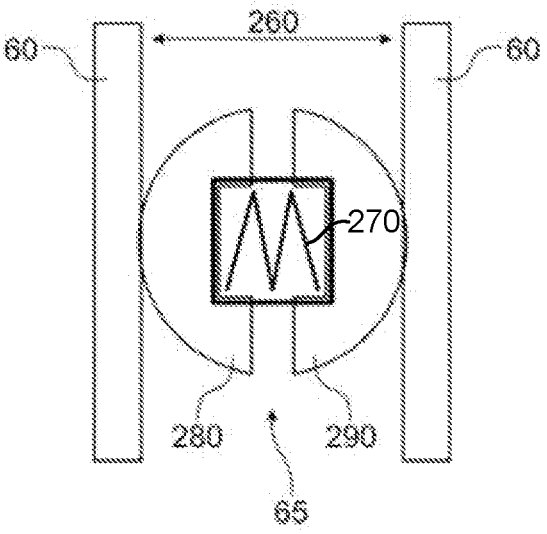
FIG. 8 shows a sliding contact between two arcing horn branches.
Figure 9:
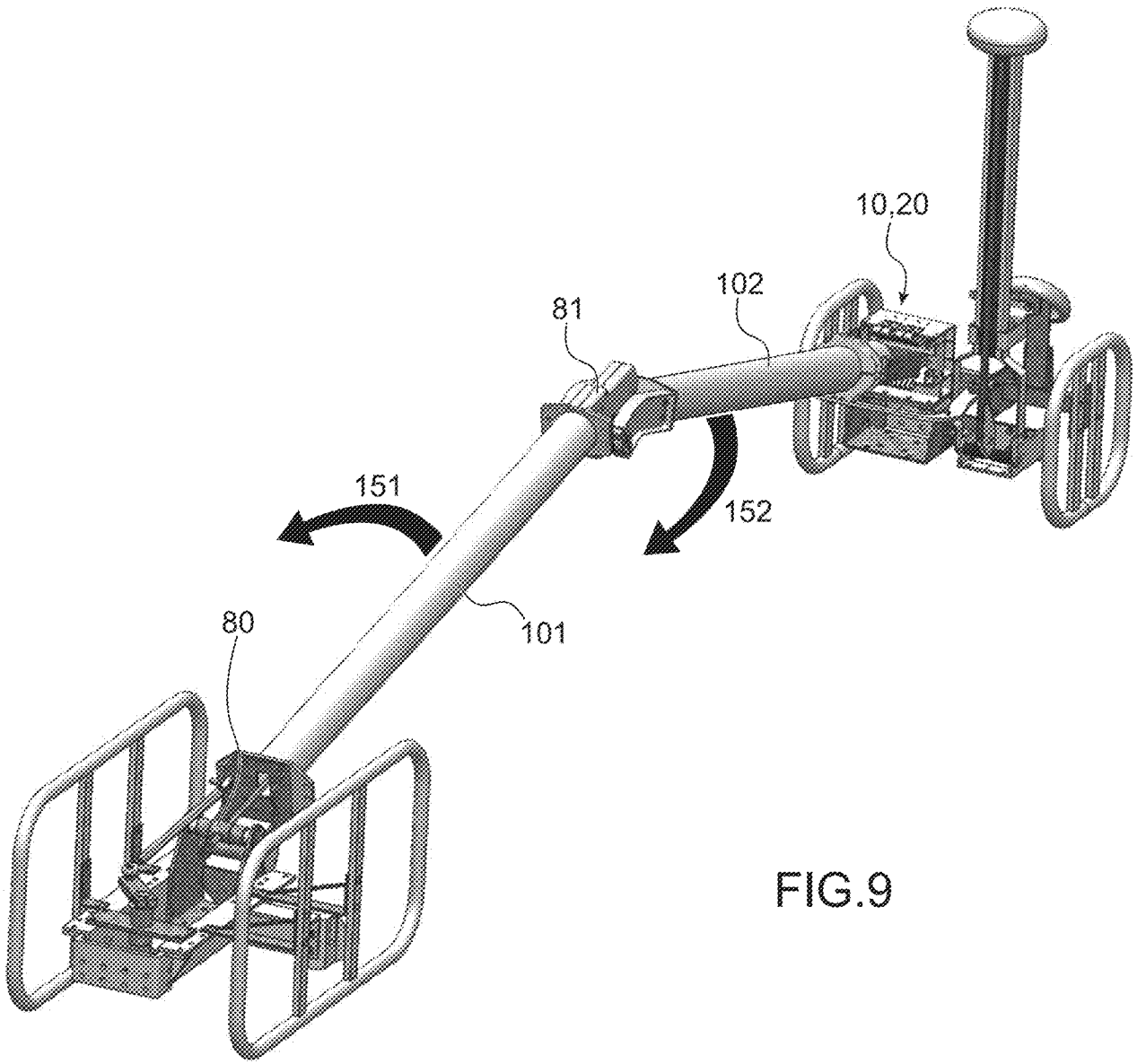
FIG. 9 shows a further disconnector in a first state.
Figure 10:
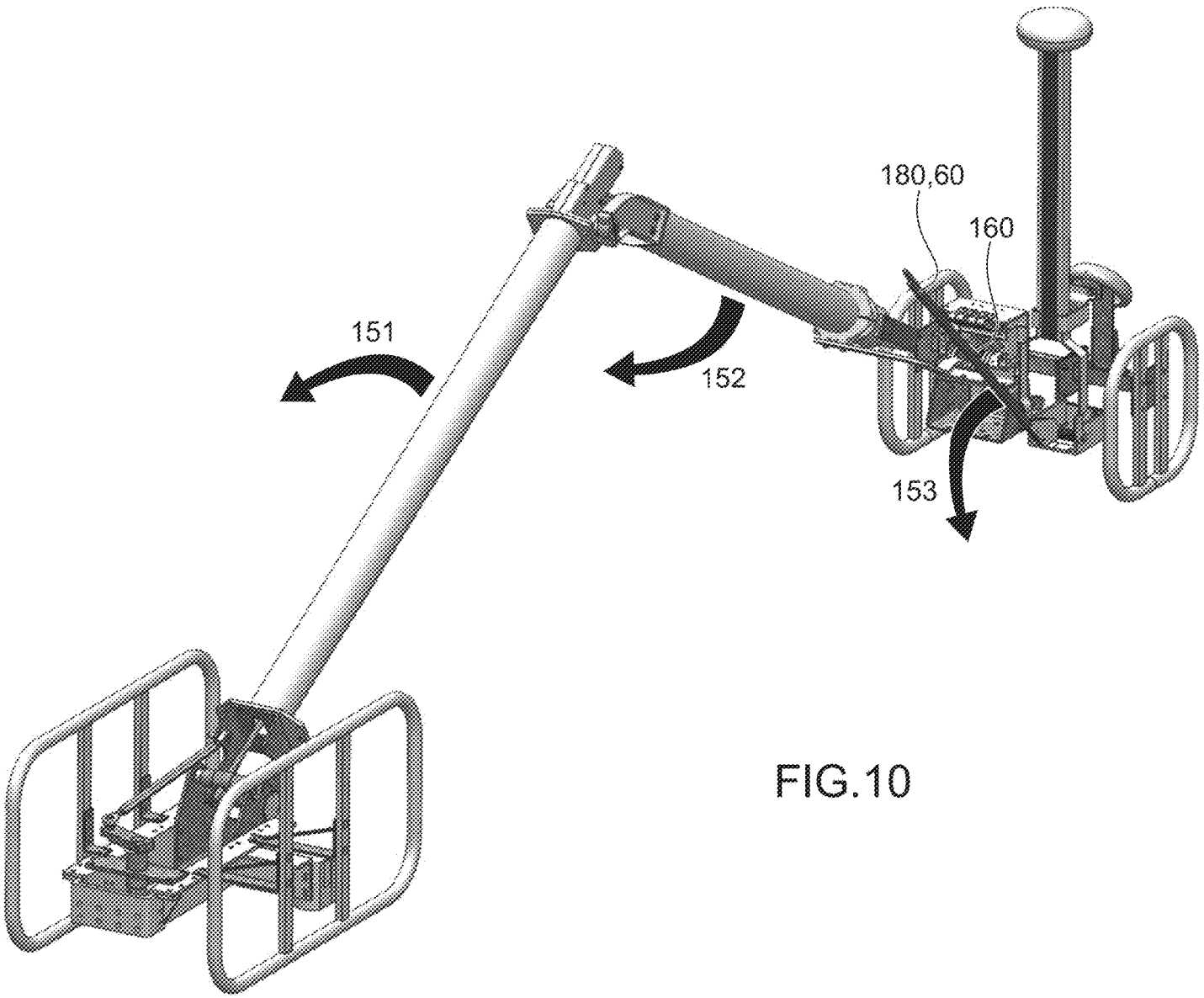
FIG. 10 shows a further disconnector in a second state.
Figure 11:
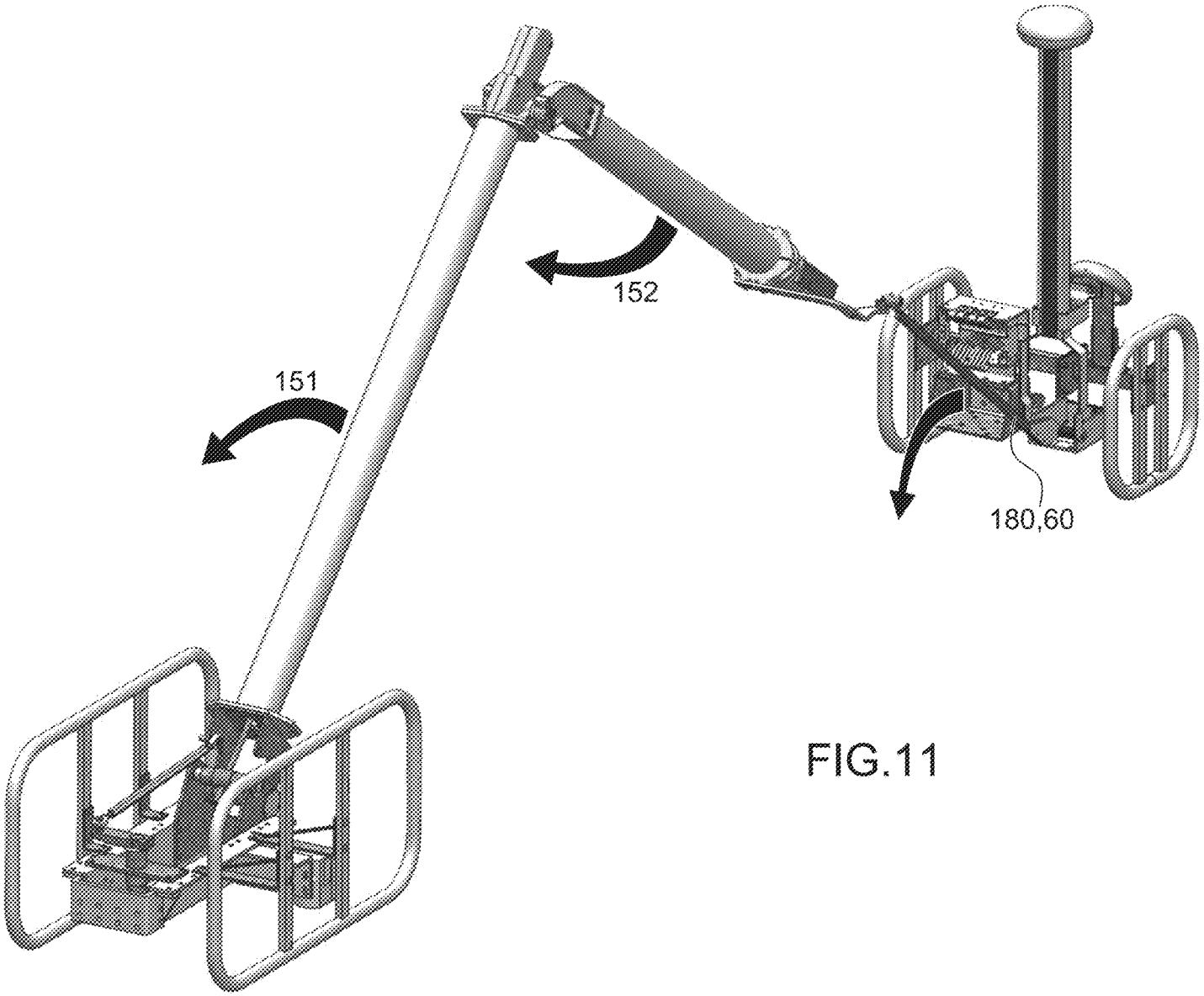
FIG. 11 shows a further disconnector in a third state.
Figure 12:
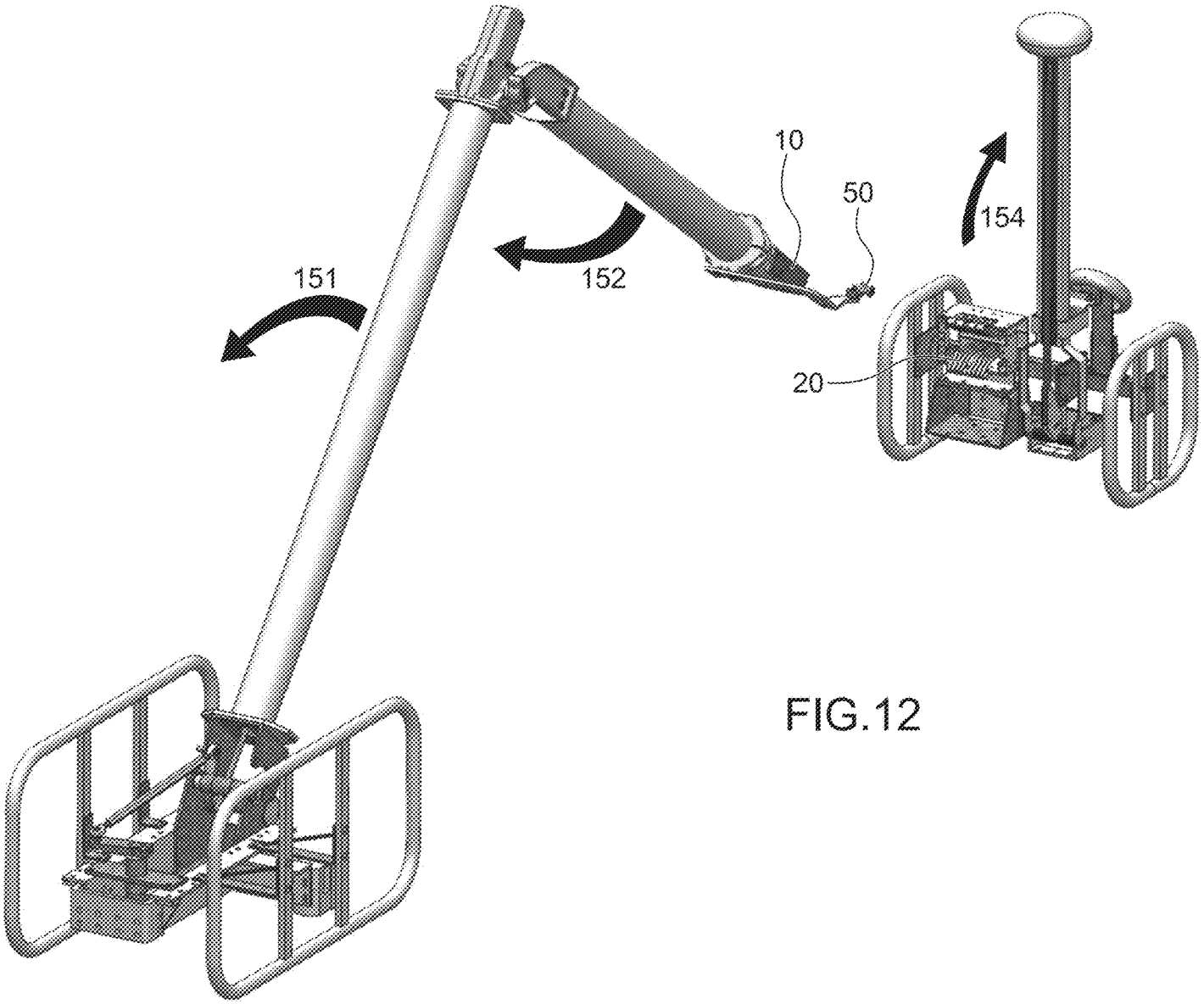
FIG. 12 shows a further disconnector in a fourth state.

FIG. 8 shows the same cut view as is shown in FIG. 7. A left and right arcing horn (60) are situated at a distance from each other such that the sliding space (260) is situated in-between them. FIG. 8 further shows the sliding contact (65) and the spring (270). The first and second sliding parts are pressed by the spring (270) against the left and right arcing horn (60). Preferably, the spring and a fixation of the spring are configured such that the spring could be compressed even more, preferably for about another 2 mm, when the sliding contact slides within the sliding space. The aforementioned pressure between the sliding contact and the arcing horn with integrated filter is set with the spring. The pressure can further be adjusted with the tie rod length. The sliding speed in combination with the pressure define a wear so if there is a higher pressure the speed must be reduced. But the speed cannot be reduced too much as a too low speed causes overheating of the resistor and possibly burning of the resistor. Preferably, the sliding contact is pressed with a force of about 50 N to about 100 N on the arcing horn. The filter and the arcing horn due to dimension and installation may be not perfectly parallel. The aforementioned sliding contact can give the right pressure on the surface on which the sliding contact slides. Further it is avoided to increase too much an operating torque which is applied from the sliding contact to the arcing horn comprising the filter.

A commercially available resistor (wire wound upon a cylindrical support) is modified in order to adapt it to the integration to the disconnector. The filter which is used together with the arcing horn typically has two layers of windings i.e. two stacks. A total length of a wire may be about 1200 mm and the wire may have a thickness of about 2 mm. The diameter of the filter on the cylindrical support may be about 60 mm or about 80 mm. A resistance of about 1000 Ohm per layer or per stack may thereby be provided.

FIG. 6.1 shows a cut through the filter shown in FIG. 5, a plane of the cut being perpendicular to the longitudinal axis of the filter. FIG. 6.2 shows a cut through the filter shown in FIG. 5, the longitudinal axis of the filter lying in the plane of the cut. FIGS. 6.1 and 6.2 show that a cement (340) is filled between the wire (310) wound upon the cylindrical support (320). The cement may be a Portland cement. A deposition of dust between turns of the wire can be prevented by the cement.

A stabilization layer (330) is inserted between the wire and the cylindrical support. This layer provides structural support. The stabilization layer preferably comprises aluminiuoxide (Al2O3).

The filter is preferably configured such that a dielectric gradient is below 20 kV per cm in order to avoid a discharge between consecutive turns of the filter coil. The dielectric gradient on the live part is less than 20 kV per cm to avoid discharge between turns. A voltage between consecutive turns of the coil is typically 1.2 kiloVolt (kV). The filter preferably has a length of 1 m to 2 m.

The filter and the sliding contact are configured such that the sliding contact has a contact with about three turns of the wire of the filter at the same time when the sliding contact is in contact with the filter.

The electrical properties of the filter may be selected based on a simulation of equivalent circuits and existing electrical grids. The values are chosen in order to provide a compromise between feasibility, filtering frequency range and presenting a good attenuation factor. A power test was carried out to demonstrate the effectiveness of the selected properties of the filter. This test used a standardized equivalent circuit representing the most stringent scenario stated by the standard IEC 62271-305:2009.

The material for the filter may be the same as for a normal commercially available filter. The material needs to work with the sliding contact at the pressure chosen and the speed chosen. A tolerance of 10% in material properties is compatible with the present application. The length of the filter is chosen from an electrical point of view. The filter diameter and tie rod are dimensioned in order to withstand mechanically the environmental conditions, i.e. a temperature range of 0° C. to +50° C. and wind and sun.

The sliding contact with the integrated filter works particularly well in a network with a Cload/Csource up to 10/1.

FIGS. 9, 10, 11 and 12 show a pantograph type disconnector. Same elements are indicated by the same reference signs in FIGS. 1-4 (vertical type disconnector) and FIGS. 9-12 (pantograph disconnector).

The pantograph comprises a first turning portion (101) and a second turning portion (102).

The first turning portion and the second turning portion are connected at a folding point (81). The sliding contact (50) is situated at an end of the second turning portion opposite the folding point (81).

During an opening movement (151, 152, 153), the first turning portion turns around the pivot point (80) in a first folding movement (151). The second turning portion (102) moves around the folding point in a second folding movement (152). During this movement, the first and the second main contact become separated and the sliding contact slides on the arcing horn (60). The arcing horn moves in a drag movement (153) while dragged by the sliding contact (see FIG. 10, 11). When the sliding contact has reached the end of the arcing horn, the arcing horn flips back in a flip movement (154) to an initial position (see FIG. 12).

As described for the vertical break disconnector, a filter (180) is integrated into the arcing horn. The sliding contact therefore slides on the filter during the opening movement and the filter becomes gradually inserted.

The invention claimed is:

1. A disconnector comprising a first main contact, a second main contact, a sliding contact, and an arcing horn having a length, the disconnector having a connected state, an intermediate state, and a disconnected state, wherein in the connected state a first electrical contact is established between the first main contact and the second main contact, in the intermediate state the first electrical contact is interrupted while a second electrical contact exists between the sliding contact and a contact position on the length of the arcing horn, and in the disconnected state the first electrical contact and the second electrical contact are interrupted, wherein at least a part of the length of the arcing horn comprises an electrical filter configured to provide a resistance and an inductance to an electrical current, and wherein the filter comprises a conducting wire wound upon a support such that two layers or more of wound wire are provided.

2. The disconnector of claim 1, wherein a continuity of contact positions exists along the length of the arcing horn comprising the electrical filter and wherein the sliding contact is configured to adopt a given contact position from the continuity of contact positions by sliding along the length of the arcing horn comprising the electrical filter.

3. The disconnector of claim 1, wherein the filter is configured such that, in use, a dielectric gradient is smaller than 20 kV per cm and/or a voltage between consecutive turns of the wire is about 1.2 kV.

4. The disconnector of claim 1, wherein the filter comprises a stabilization layer, preferably a stabilization layer comprising an aluminum oxide, the stabilization layer being provided between the wire and the support.

5. The disconnector of claim 1, wherein a cement is filled between windings of the conducting wire.

6. The disconnector of claim 1, wherein the filter and the sliding contact are configured such that the sliding contact is in contact with at least three windings of the wire while sliding on the filter.

7. The disconnector of claim 1, wherein the filter is connected to the arcing horn via a connection cylinder, the connection cylinder being dimensioned such that an impedance is adapted to the filter.

8. The disconnector of claim 1, wherein an opening and/or closing operation is configured such that the sliding contact moves with a constant sliding speed while the sliding contact is in contact with the filter.

9. The disconnector of claim 1, wherein an opening and/or closing operation is configured such that the sliding contact moves with a sliding speed, whereby the sliding speed increases or decreases while the sliding contact is not in contact with the filter.

10. The disconnector of claim 1, wherein the disconnector is configured as a vertical type disconnector with the arcing horn comprising a left branch with a first electrical filter and a right branch with a second electrical filter, wherein the sliding contact is configured to slide in a sliding space between the left branch and the right branch of the arcing horn.

11. The disconnector of claim 10, wherein the sliding contact comprises a first sliding part, a second sliding part and a spring, wherein the spring is configured to press the first sliding part and the second sliding part against the left branch and against the right branch of the arcing horn.

12. The disconnector of claim 10 comprising a length adjustable tie-rod, wherein the length adjustable tie rod is configured such that changing a length adjustable tie-rod length leads to a change of a sliding space size.

13. The disconnector of claim 1, wherein the sliding contact is pressed with a force between about 50 N and about 100 N on the arcing horn.

* * * * *